US005927043A

United States Patent [19]

Newkirk

[11] Patent Number: 5,927,043

[45] Date of Patent: Jul. 27, 1999

[54] HOUSING ASSEMBLY

[76] Inventor: Christian R. Newkirk, 1519 Ridge Rd., McHenry, Ill. 60050

[21] Appl. No.: 08/975,300

[22] Filed: Nov. 20, 1997

Related U.S. Application Data

[62] Division of application No. 08/833,243, Apr. 17, 1997, Pat. No. 5,881,519.

[51] Int. Cl.[6] ..... E04G 11/08; E04G 15/02; E04B 2/84

[52] U.S. Cl. ..... 52/742.14; 52/677; 52/745.1; 249/33; 249/35; 249/39; 249/189; 249/210

[58] Field of Search ..... 52/677, 274, 284, 52/285.2, 309.12, 309.17, 748.14, 745.1, 742.14; 249/33, 35, 36, 39, 189, 210

[56] References Cited

U.S. PATENT DOCUMENTS

| | | | |
|---|---|---|---|
| 2,683,913 | 7/1954 | Honnigford | 249/39 X |
| 3,280,529 | 10/1966 | Reuss | 52/677 X |
| 4,138,084 | 2/1979 | Reid | 249/39 X |
| 4,320,606 | 3/1982 | GangaRao | 52/600 X |
| 4,463,538 | 8/1984 | Dragunas | 52/677 |
| 5,169,544 | 12/1992 | Stanfill et al. | 249/35 X |
| 5,232,646 | 8/1993 | Nasvik et al. | 249/35 X |

*Primary Examiner*—Christopher Kent
*Attorney, Agent, or Firm*—Mathew R. P. Perrone, Jr.

[57] ABSTRACT

A house may be assembled from a plurality of vertically-cast wall sections and produce an aesthetically pleasing, highly desirable home at reduced cost.

11 Claims, 8 Drawing Sheets

100
128
130
526
524
138
132
134
150
522
520
512
536
514
506
508
502
150
512
514
172
332
500
154
102
504
330

FIG. 5
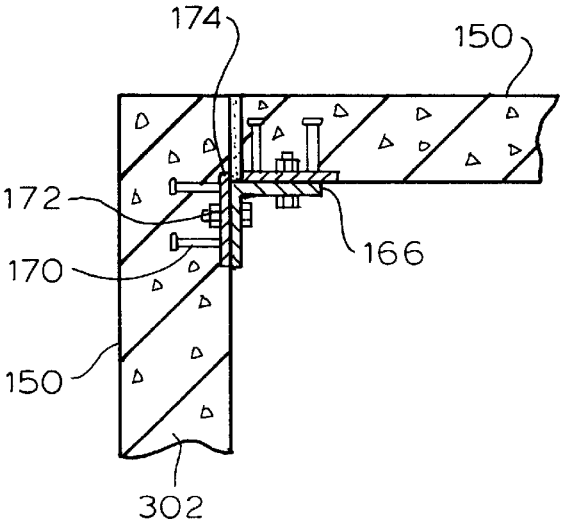
FIG. 7
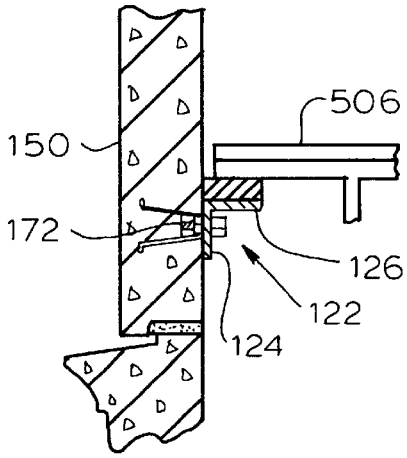
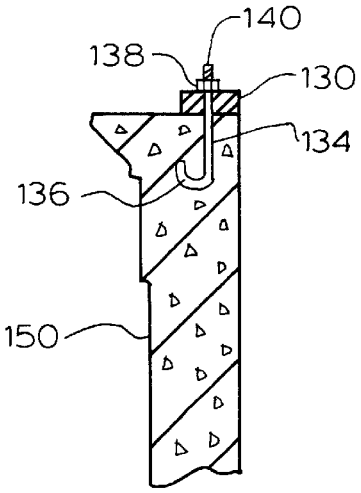
FIG. 6
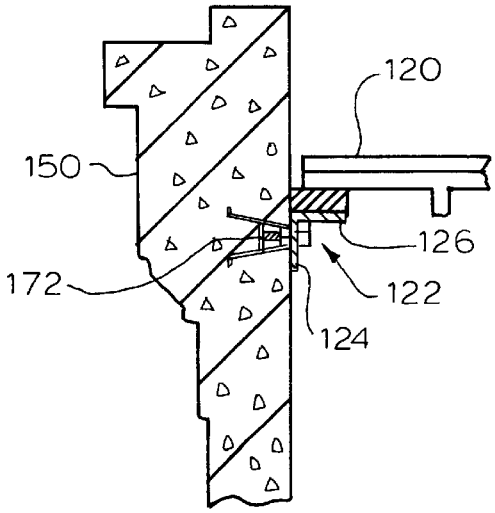
FIG. 8

FIG. 14
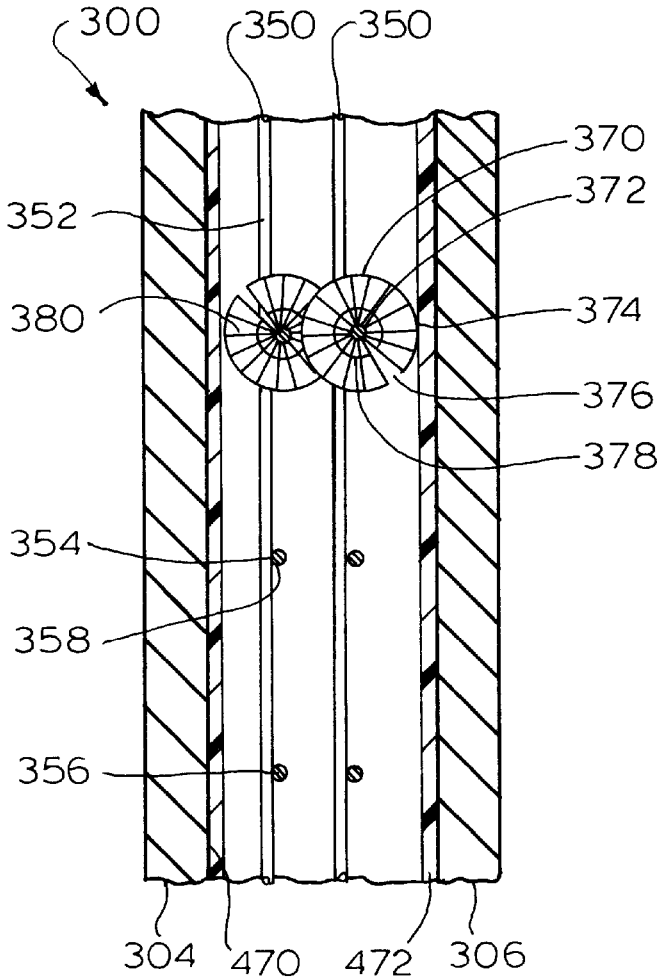
FIG. 15
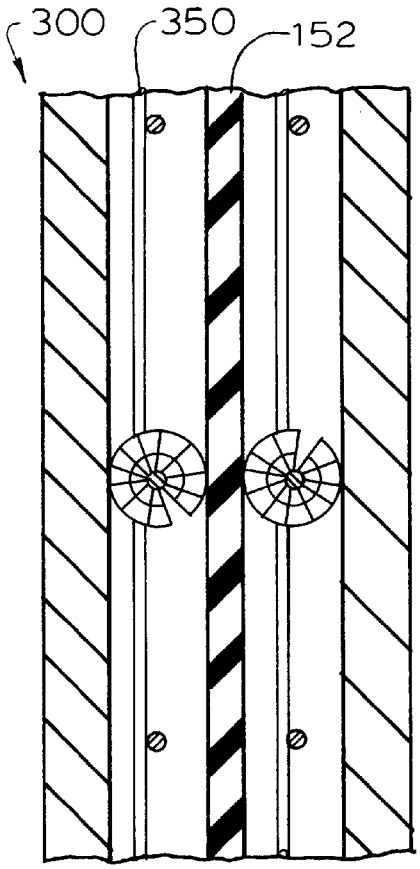
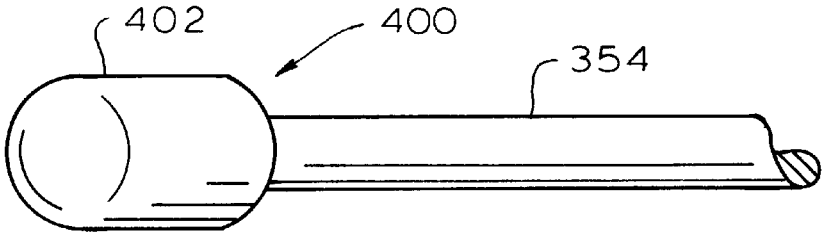
FIG. 16

HOUSING ASSEMBLY

CROSS REFERENCE TO RELATED APPLICATION

This application is a divisional application of U.S. patent application Ser. No. 08/833,243, filed Apr. 17, 1997, now U.S. Pat. No. 5,881,519.

This invention relates to a housing assembly formed from slabs from the precast concrete industry and more particularly to a housing assembly formed from vertically-cast, concrete slabs.

BACKGROUND OF THE INVENTION

Housing construction is important to the health and welfare of any people. As a general rule, as the quality, quantity, and availability of housing improve, cost does too. Location and construction difficulties adversely affect housing availability and quantity also. It is very desirable to provide housing quality and quantity at a low cost.

The cost of construction of housing is a major problem in solving the housing shortage. There are certain skills that are required for producing housing. Even if the housing is produced in an efficient preplanned manner, it still requires a great amount of skill and dexterity to achieve to complete the house. This variety of skills requires specialists in the field of housing construction including, but not limited to carpenters, electricians, plumbers, and people having similar skills.

It is highly desirable to produce low cost housing in an efficient fashion. If this can be done, the living standard of people can be improved at a reduced cost. Prefabrication of housing is useful in cost reduction. The higher the level of prefabrication, the greater efficiencies of production can be obtained.

Current prefabricated housing is either difficult to assemble, difficult to make, or difficult to transport. If the transportation and assembly problems can be reduced, great advantages are obtained.

Insulation and exterior noise resistance are also important for a house. These features usually must be installed on site. This factor requires an additional skilled worker on the site. Reduction of these on site construction efforts are desired.

It is also difficult to provide appropriate decoration or aesthetic appearance to housing. If the housing lacks certain aesthetic appearance, and becomes unacceptable in the sight of the consumer, the advantages of the efficiency for the housing can be greatly outweighed. Accordingly, it is desired to provide an efficient manner of providing housing while at the same time maintaining an aesthetic appearance.

A particular housing problem is caused by low income housing. The occupants of such housing lack the necessary income or other abilities to obtain proper housing. Many attempts are known to provide proper low cost housing, which attempts have clearly failed to do so.

An attempt has been made to solve the low income housing problem by providing high rise buildings with apartments therein for each family unit- However, these buildings create a substantial number of problems. Gangs of youths make such buildings difficult to safely be inhabited.

Another problem in construction can be vandalism. Such damage is expensive to repair. If a building under construction can be swiftly and easily secured, such vandalism can minimized. Yet it is difficult to provide such security in the early stages of construction.

Even the spray paint damage applied to the structure in inappropriate places can be expensive to repair. Removing of the paint is difficult, especially without damaging the underlying wall. So if the problems of such spray painting can be minimized, great advantages may be obtained.

Even during the 1996 Olympic Games, new townhouses, provided for people who were required to move because of the Olympics, cannot solve the problem. While the townhouses were in substantially better condition than the individual houses the people left, the joining of the houses create certain problems among the neighbors. Thus, it is highly desirable to find an inexpensive efficient method of providing low cost housing.

Since the townhouses and apartments cannot solve the problem, single family homes are desirable. Such homes are too expensive. Changes must be made to solve this problem.

SUMMARY OF THE INVENTION

Among the many objectives of this invention is the provision of a house formed from molded walls.

Another objective of this invention is to provide a house having a decorative outer surface.

Yet another objective of this invention is to provide a house having a decorative inner surface.

Still another objective of this invention is to provide a house with labor having less skill than is customarily required.

Additionally, an objective of this invention is to provide a house, which is easily assembled.

Also, an objective of this invention is to provide a house, from materials, which are easily transported.

A further objective of this invention is to provide a high quality house.

A still further objective of this invention is to provide an efficiently produced house.

Yet a further objective of this invention is to provide a house having a noise reflecting surface.

Another objective of this invention is to provide a house requiring on site construction efforts.

These and other objectives of the invention (which other objectives become clear by consideration of the specification, claims and drawings as a whole) are met by providing a house assembled from a plurality of vertically-cast wall sections.

BRIEF DESCRIPTION OF DRAWINGS

FIG. 5 depicts a top plan view of a first panel 150 used in house 100 joined to a second panel 150 at a right angle in partial cross-section.

FIG. 6 depicts a side view of panel 150 used with gabled roof 128 in partial cross-section.

FIG. 7 depicts a side view of panel 150 used with first floor 506 in partial cross-section.

FIG. 8 depicts a side view of panel 150 used with first floor 506 in partial cross-section, which depicts FIG. 7 rotated 90 degrees about the horizontal axis.

FIG. 14 depicts an end view of forming assemblies 300, in partial cross-section.

FIG. 15 depicts an end view of forming assemblies 300 with retainable insulation 152 to remain within panel 150, in partial cross-section.

FIG. 16 depicts a straight spacer 400 for forming assemblies 300.

Throughout the figures of the drawings where the same part appears in more than one figure the same number is applied thereto.

DESCRIPTION OF THE PREFERRED EMBODIMENTS

Figure 1:
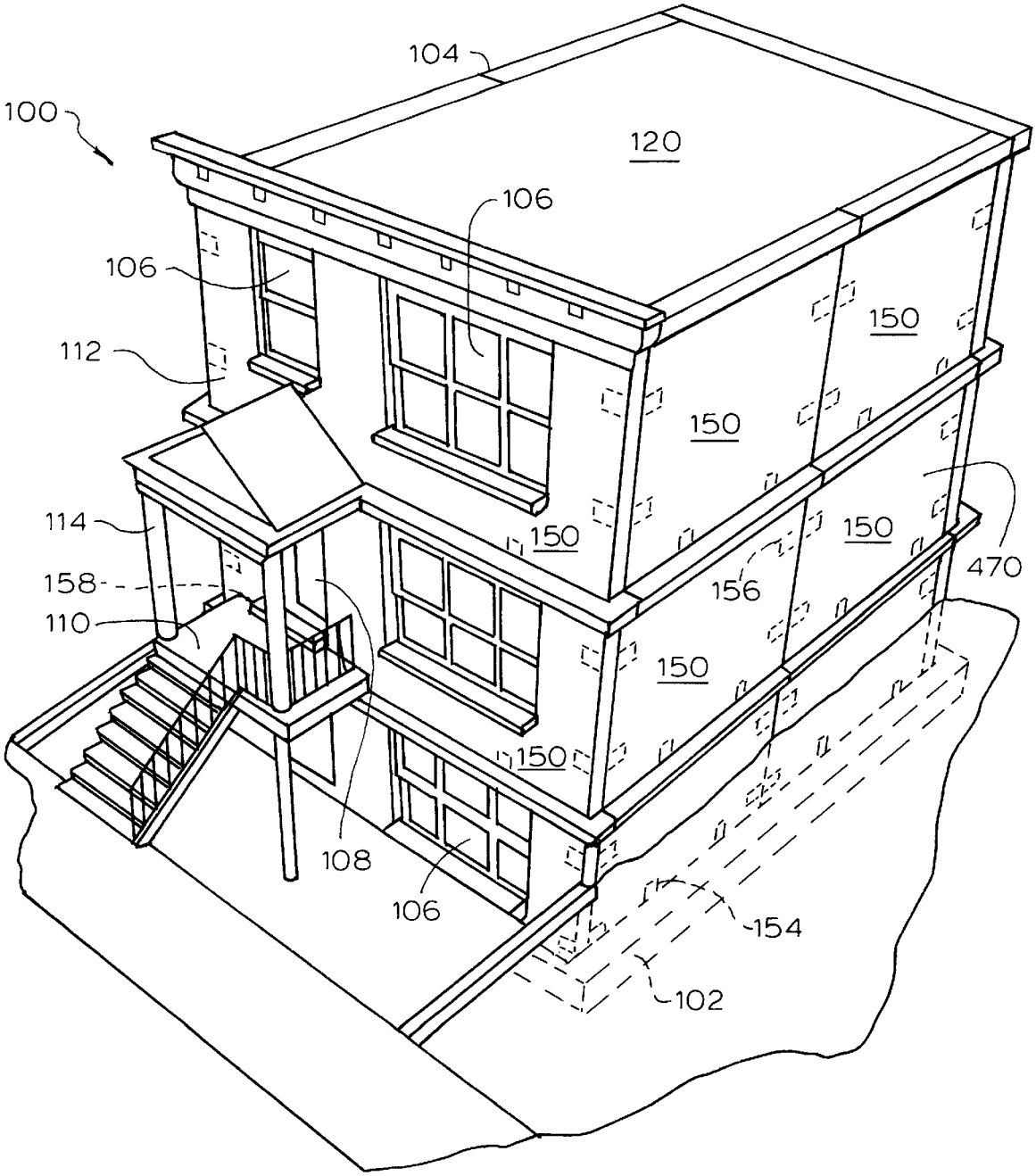
FIG. 1 depicts a front perspective view of a house 100 formed from vertically cast panels of this invention with a flat roof 120.

A house may be assembled by having sections for the house formed and then assembling the house from the sections. Each section includes a panel and a beam. The sections are formed by vertical casting. The panel has a much larger surface area than the beam. The beam has a greater thickness than the panel. The beam appears at the top of the panel.

During the vertical casting, the beam is formed at the top of the mold, while the panel is below the beam. While the panel is being used, the beam is at the top of a story or floor in the house. Such vertical casting and direct vertical use greatly simplifies the formation and use of the sections.

The panels can be formed with the same or different designs or decorations on either side of the panel. An appropriate exterior decoration is provided for the exterior of the house. An appropriate interior decoration is provided for the interior walls of the house, as formed by the panels. This interior decoration on the wall of the house formed by the panel rough or smooth as desired. Only the appropriate mold lining need be adhered or otherwise secured to the wall of the mold.

The wall formed by the panel may be of any desired height. This height can be set by the mold. The length of the panel is also set by the mold. As many panels as desired may be used to form any size of house or any number of stories. The story or floor limit of the house is preferably three. These sections permit the precast concrete industry to provide the efficient building of aesthetically pleasing houses.

Typically, the section has a mounting beam and a panel combination for the section, wherein the mounting beam and the panel may be positioned in a substantially co-planar position. Within the panel mounted precisely during the molding process are attachment points for joining the panels together, both horizontally and vertically. Plates connect an attachment point in one panel with an attachment point in a adjoining panel. This structure permits the sections to be formed into a wall of a house or other building.

The vertical casting of the panel combined with the heavier weight beam member being at the top of the mold permits the formation of panels, including openings in the panel for windows or doors right in the panel. It is also permitted to make a solid panel with the appropriate interior or exterior decorations. These panels can then be formed into an appropriate house or other building.

Each panel has a generally rectangular shape. Within the panel, along each edge of the rectangular shape, are a plurality of devices designed to join one panel to another, or join a panel to a foundation, or join a panel to a roof. Supplemental joining points may provide for a deck or similar structure on the house.

At each corner position of a panel of a panel are corner mounts which are used to join a corner of one panel to the corner of another panel to form the corner of a house. At the top of the panel and at the base of the panel are mounting positions permitting securing to a foundation or another panel.

The mounting positions in the top permit securing of the panel to the roof or an adjoining panel. In this fashion, a residence or house, or other building having a plurality stories may be obtained. In the casting mechanism, appropriate panels or mold shapings are achieved in order to provide the position for the windows to be inserted. With this accomplishment, the shaping and positioning of the windows and doors in a panel are easily managed.

In each panel are edge mounts, corner mounts, and top and bottom mounts. With the edge mounts, one panel is joined to the other on a side edge thereof. On the top of the panel, the top mounts communicate with bottom mounts of an adjoining panel to achieve the desired results.

The edge mounted brackets include apertured panels molded right into the side panel. These apertured panels align with adjoining apertured panels due to the preciseness of the casting. These apertured panels can then be bolted together to share the edge of the panel to the edge of another panel. The desired casting step also permits the adjustment of the joining position.

In the base of the panel, there are both apertures and apertured panels for securing the panel to the foundation or an adjacent panel. The apertures adjacent to the base permit joining one panel to the other on the three edges. The top beam of the panel permits the abutment a bottom edge of an adjoining panel thereto, in order to construct a building having two or more stories.

The mounting bolts can be mounted along the panels molded into the panels. These mounting plates are positioned within sections of the mold. In this fashion, they are molded right within the concrete wall of the panel. Because of the precise positioning in the mold, and the precise positioning of mounting devices to attach the board to the base, very minimal on site work is required for setting up the shell of the building.

These panels can form shells for a house or other building, which can be set up and secured in one day. Because of the concrete nature of the walls, and the closability of the windows with a relatively impermeable material, great advantages are obtained. A secure set of panels provides a lockable system to protect the construction sight until the next day.

The particular coloration used on the houses is easily matched and painted over. This fashion permits an easy removal or a simple cover up of undesirable decorations put on the building by pranksters.

The forming assembly for a section include a first form and a second form. The first form and the second form may be moved toward each other. At that point, a flowable material may be poured therebetween to form a section. After the flowable material hardens, the first form and the second form may be separated, in order to remove the section.

The first form may have a surface similar to that of a building exterior caused by the presence of a first mold liner. The same or a different surface may be on the second form, caused by the presence of a second mold liner. Preferably, the second mold liner is a different surface, suitable for use as the interior wall of a house.

The slotted spiked wheel chairs space the wire reinforcement from the wall formed by the concrete in an efficient manner while permitting the use of the reinforcements. It is also possible to produce a slot in the wire reinforcement and provide foam insulation in the wall section. In this fashion, the wall section can be made to keep the resulting house extremely well insulated for warmth or cooling, and easily provide a great deal of insulation. This structure provides an efficient method of providing low cost housing.

If a particular structure is desirable for the outside, the mold form, as a liner, can be made in a flat shaping arrangement. An appropriate casting resin may then be placed over the structure. This solidified casting resin may be then inserted into the mold. This structure permits the proper appearance of the outside structure. This, with the stain or surface coloring, provides a desirable feature for the exterior of the house. The surface coloring is preferably a thermoplastic acrylic concrete stain.

Likewise on the interior, the other mold form of the forming assembly can be made extremely smooth and provide an extremely smooth concrete appearance, which is especially suitable for an interior wall of the house. Within the shell for the building created by the walls outlined by the panels, a standard plaster board and studded wall may be created to divide the building into rooms.

Insulation may be instead within the panels during the molding process. Studded walls may also be set up within the shell formed by the panels. An appropriate insulation may be inserted between the wall support in a standard form. So insulation may be in the wall support, in the panels or both.

In a typical fashion, two opposing sides of the house are made up of one, two or three panels, while the other two opposing sides of the rectangular shaped house are achieved with one, two or three pairs of panels to make an appropriate length. In this manner, a one, two or three story house may be made.

The appropriate adjustment in the mold form, and particularly the liner, can produce a panel having an exterior seamless appearance such that the panel divisions are invisible to the naked eye. In this fashion, the external appearance of the house avoids the exterior appearance of a house made from slabs, while the internal appearance of the house permits proper decoration in a standard fashion.

With the various molded panels, made from urethane or equivalent resins, it is thus possible to make the desired surface. It is also possible to use the urethane mixtures to achieve the desired results of an acceptable exterior finish and proceed with the building of a simple house. In construction, these panels may be assembled into a securable cell in less than one day. The durability of the panels and the easy covering of the outside surface permits the panels to be easily restained or recolored to a desired color at the desired section in the event of any defacing features on the panel, without repainting the entire surface.

Referring now to FIG. 1, a house 100 is formed from vertically cast panels 150. This particular house 100 has a flat roof 120. The front, the rear, and the sides 470 of the house 100 are formed from panels 150.

In particular, each side of the house 100 has three pairs of panels 150. The panels 150 on the sides 104, while shown without windows 106 may be formed in a fashion similar to panels 150 in the house front 112 of house 100, shown with windows 106 and doors 108. The porch and steps 110 are bolted to house 100 with a plate mechanism 158 and supported by porch posts 114 appropriately. As standard porch and steps 110 are depicted supported by porch posts 114, door 108 becomes accessible.

The lower panels 150 are secured by foundation plates 154 to a foundation 102, poured in concrete in standard fashion, as a foundation 102. The panels 150 are also secured to each other by panel plates 156. The panel plates 156 and the foundation plates 154 may be similar in structure.

Figure 2:
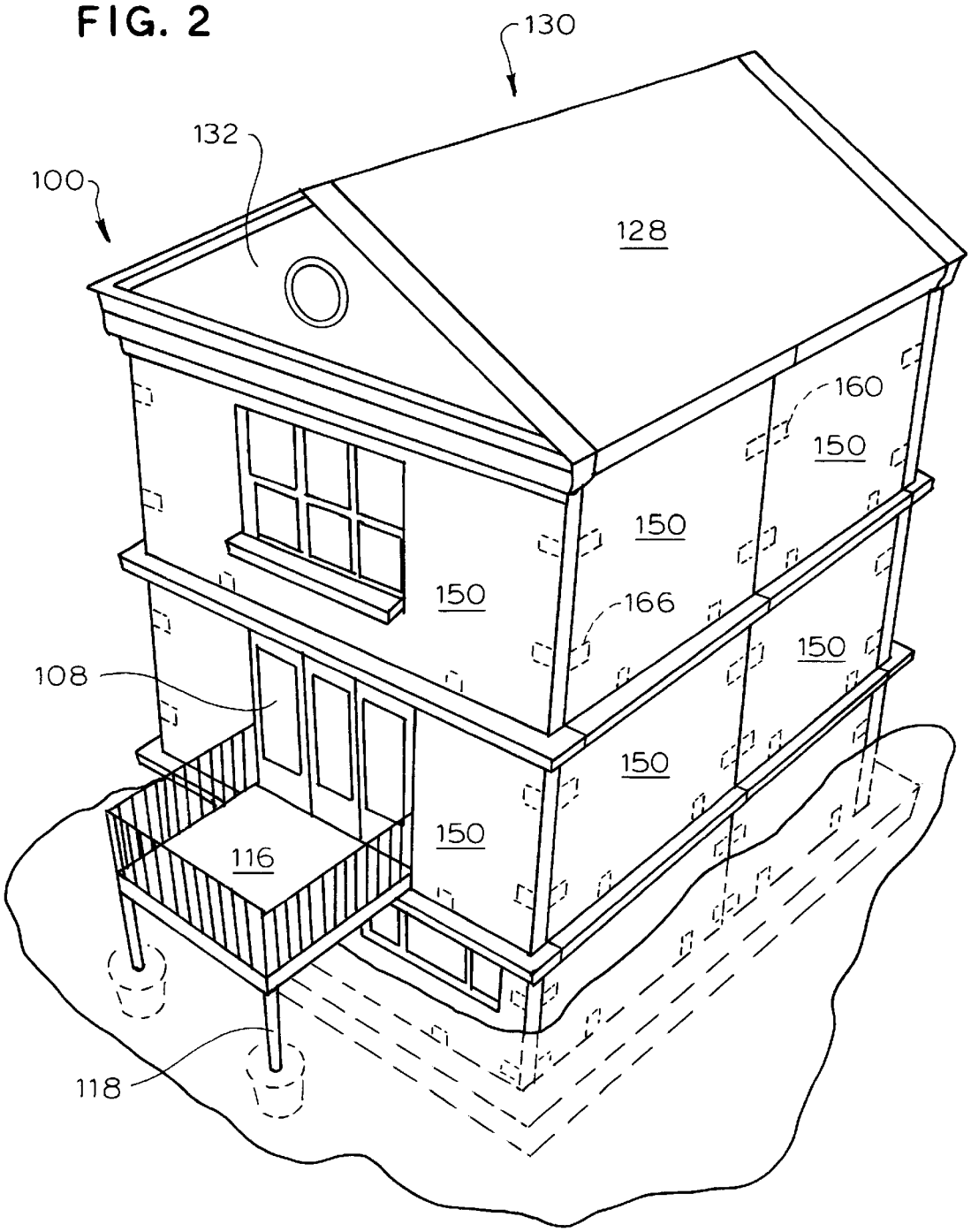
FIG. 2 depicts a rear perspective view of a house 100 formed from vertically cast panels of this invention with a gabled roof 128.

As can be seen in FIG. 2, it is possible to provide a gabled roof 130 for house 100. Gabled roof 130 includes a gable 132 at each end thereof, with a sloped roof 128 mounted thereon. The gables 130 are shaped in any suitable fashion and mounted by bolting to the panels 150. In this fashion, the gabled roof 128 can be completed. A deck 116 is supported on the deck posts 118, at the rear of house 100, in a standard fashion.

Figure 3:
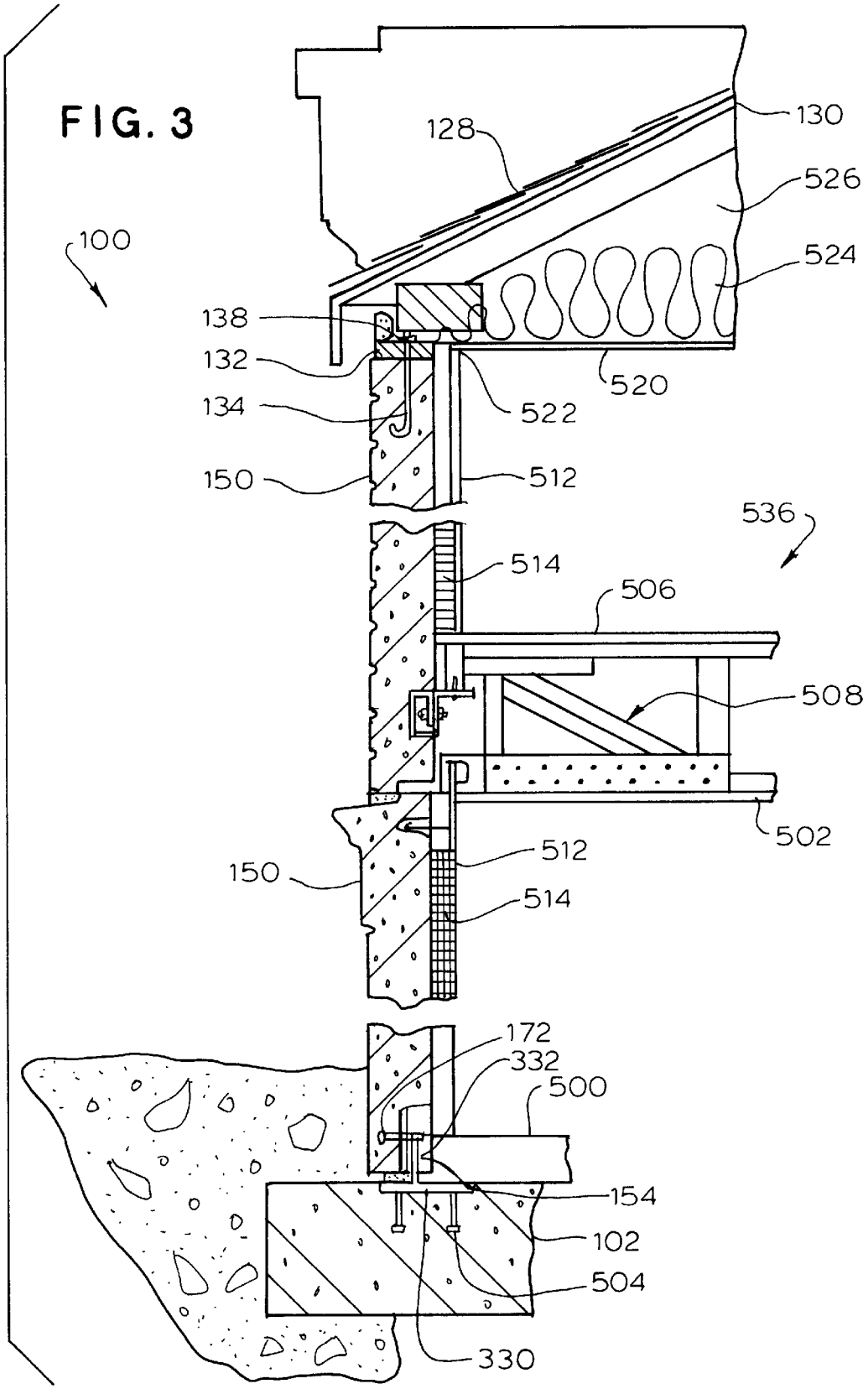
FIG. 3 depicts an end plan view of house 100 with a gabled roof 128 of FIG. 2 in partial cross-section.

Referring now to FIG. 3, a side wall of house 100 with gabled roof 128 is depicted. The panels 150 are bolted together with plates 156. The porch 110 is attached to house 100 in a standard fashion extending from the panels 150.

Likewise the panels 150 may be shown as welded or otherwise secured to the foundation 102 in standard fashion. The panel mounts 170 plates 154 are positioned in the forming assemblies 300 before the concrete 302 is poured in place. In this fashion, there is an accurate placement of the required panel mounts 170.

It is thus possible to weld the panel 150 to the foundation 102, and bolt the panel 150 to another panel 150, and bolt the flat roof 120 or the gabled roof 128 to the panel 150. In this fashion, a very sturdy house 100 is achieved. More specifically, a panel 150 is shown as mounted on top of a panel 150, or side to side by flat plates 160, more clearly described with reference to FIG. 10.

Also in FIG. 3, panels 150 are shown as having standard housing structures mounted in there. More particularly, a lower panel 150 is mounted to foundation 102. The a basement floor 500 is poured in the foundation.

A floor 506 can be inserted with a wood floor truss 508 on a basement ceiling 502. Other floors in multi-story building can be mounted in the same fashion. Such structures are well known in the art. Also, on the interior of the panel 150 an additional surface 512 can be applied over wall insulation 514, thereby achieving the desired insulation value of the house 100.

A ceiling 520 can be mounted to the underside of the roof in house 100, whether flat roof 120 or gabled roof 128. Attic insulation 524 can be provided in the attic 526 under the gabled roof 128. In this fashion, the standard structure of a house 100 can be maintained within the house 100 while at the same time providing the exterior of the house 100, and permitting the attachment of the panels 150.

Within the foundation 102 of the house 100 is mounted a foundation plate 330 to receive connection plate 332. The connection plate 332 is welded to foundation plate 330. It is thus possible to mount and secure every element of house 100. Within the basement floor 500 and the basement ceiling 508, the first floor 506 of the house 100 can be mounted as a concrete floor. Preferably, the basement floor 500 is concrete.

At the top of the panel 150, where the gabled roof 128 is attached, a J-hook bracket 134 is embedded into the concrete 302. J-hook bracket 134 is mounted in the forming assemblies 300 before the concrete 302 is poured. Over that J-hook bracket 134 is placed gable 130. A nut 138 then secures the gable 130 and, thence, the gabled roof 128 to the house 100 at top panel 150.

Figure 4:
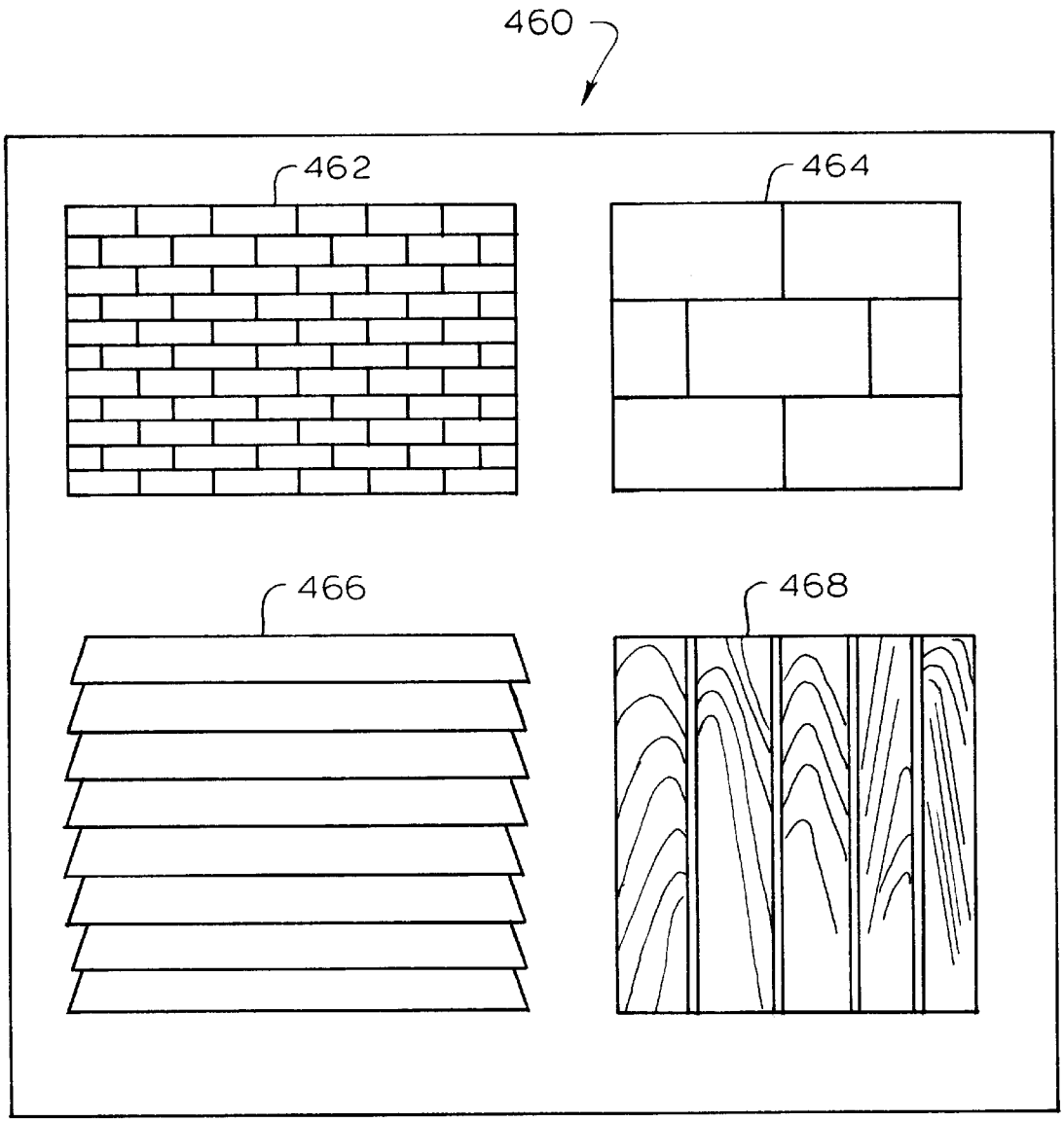
FIG. 4 depicts a plan view of panel designs for panel 150 used in house 100.

FIG. 4, depicts the various surfaces 460, which may be applied to the panel 150. It is possible to form these surfaces. Typical surfaces for the exterior include brick 462, block 464, siding 466, wood 468 and others to form a decorative exterior 470 (FIG. 1) on panel 150 by using a liner 472 (FIG. 9) to be used in forming assemblies 300.

The typical surfaces can be formed by making the desired surface, pouring a settable resin resistant to concrete thereover, recovering that thus formed resin with the imprint of the desired surface thereon, and inserting that resin in the forming assemblies 300 as a liner on first form 304.

If it is desired to have a flat side on the wall, a flat surface on liner 472 for the forming assemblies 300, in particular on first mold form 304, can achieve a wall similar to the standard interior wall of a house 100. A flat liner 472 may achieve this purpose, by casting a on flat surface as above described. In fact, it is difficult to detect the difference in the concrete interior wall and the interior drywall or other standard wall.

Referring now to FIG. 5, angle plate 166 (also called an angle bracket) is shown as attaching a first panel 150 to a second panel 150 at a right angle. In this fashion, the corner of house 100 is formed. Angle plate 166 slides over exposed bolts 176 mounted in panels 150 during the erection process for house 100.

Figure 13:
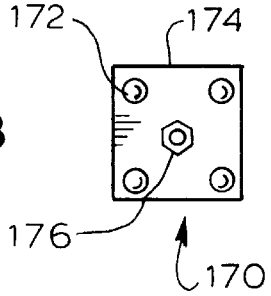
FIG. 13 depicts a top plan view of panel plate 170.

In FIG. 13, these exposed bolts 176 form part of panel mount 170. Exposed bolts 176, which extend from the surface of panel 150 have an anchoring seat 174, with support studs 176. Anchoring seat 174 and support studs 176 are mounted within the concrete 302 during the pouring process. With this anchoring seat 174, the appropriate support is found for the panel 150 to panel 150 with exposed bolts 176. These exposed bolts 176 form a strong connection especially in view of the angled brackets 166.

FIG. 6 depicts a closeup view of the J-hook bracket 134 for attaching the gabled roof 128 to the panel 150 shown in FIG. 3. The J-bracket 134 has a hook end 136 embedded in concrete by the molding process. A threaded arm end 140 extends from the hook end 136 to complete J-bracket 136. Hook end 136 is strongly secured in the concrete 302. Threaded arm end 140 receives gable 130 and a roof nut 138. As many J-brackets 134 as desired may be used to hold gable 130 and support gabled roof 128. In this fashion, the clear strength of the gabled roof 128 can be seen.

FIG. 7 and FIG. 8 combine to depict the two views of the side bracket 122 for supporting the floor 506. The side bracket 122 is again mounted on a stud 172 embedded in the panel 150. With the side bracket 122, a first side 124 is placed against the panel 150 while a second side 126 extends and designed to receive the flat roof 120. In this fashion, the flat roof 120 may be supported.

Figure 9:
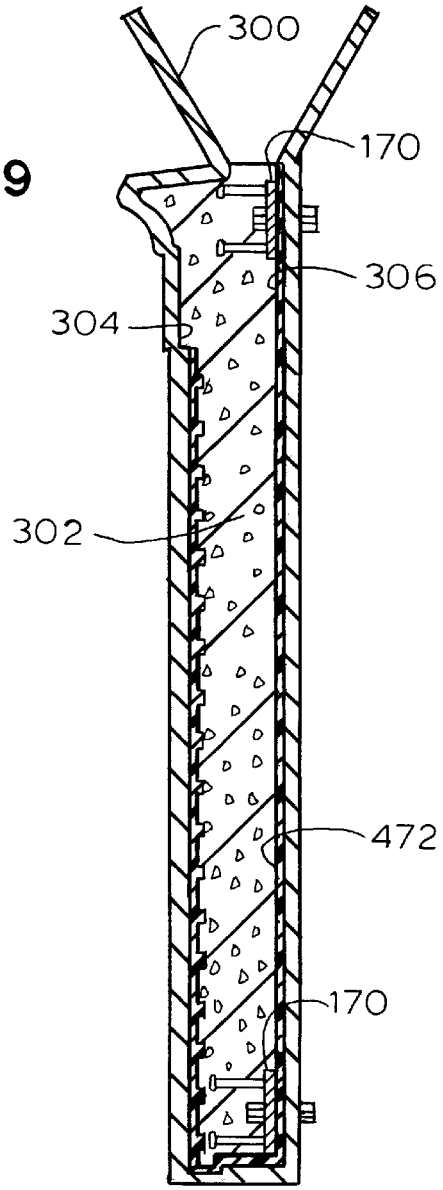
FIG. 9 depicts end plan view of panel 150 positioned in forming assembly 300, in partial cross-section.

With the addition of FIG. 9 to the discussion, the forming structure of the panel 150 becomes clear. Forming assembly 300 has a first mold form 304 and a second mold form 306, which are set up and then moved together to receive concrete 302. Mounted in the second mold form 306 are panel mounts 170 for holding one panel 150 to the other. The concrete 302 is then poured into the forming assembly 300. This casting of panels 150 is done with forming assembly 300 in a vertical position so that the handling of the panels 150 is minimized.

Figure 10:
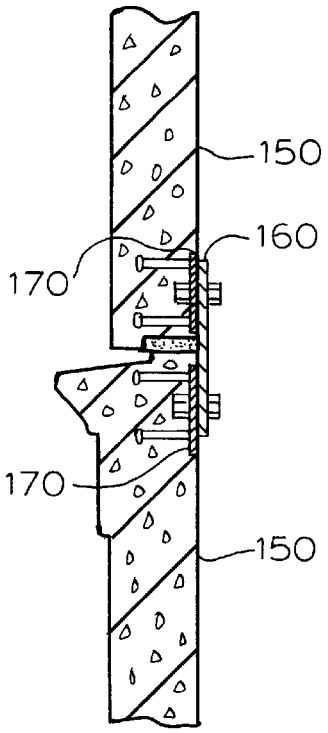
FIG. 10 depicts a side view of first panel 150 joined to a second panel 150 one on top of the other used to form part of house 100, in partial cross-section.
Figure 11:
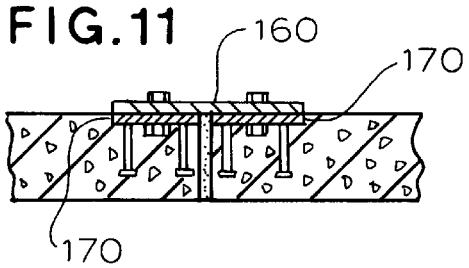
FIG. 11 depicts a top plan view of a first panel 150 joined to a second panel 150 in a side by side fashion, used to form part of house 100, in partial cross-section.

In FIG. 10 (panel 150 to panel 150 vertical) and FIG. 11 (panel 150 secured to a second panel 150 horizontal), two of panels 150 are combined. They are bolted together edge to edge by flat plates 160 mounted on adjoining panel mounts 170, and the appropriate strength for house 100 is provided. This is especially in true of the panel mounts 170, that are provided within the forming assemblies 300, and secured within the panel 150 by the pouring of concrete 302.

Figure 12:
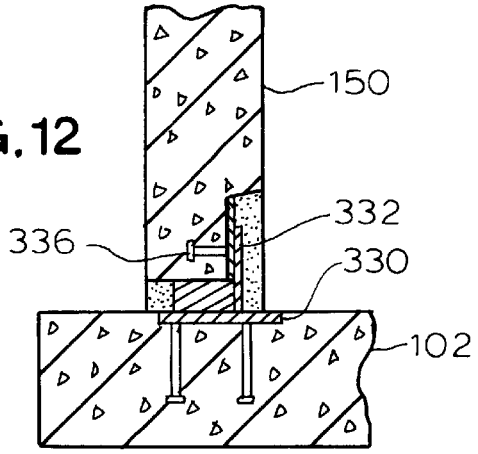
FIG. 12 depicts a side view of first panel 150 joined on top of the foundation 102 for house 100, in partial cross-section.

In FIG. 12, the foundation plate 330 is depicted. The foundation plate 330 receives the panel 150. The foundation plate 330 has a connecting plate 332, which permits the securing of the panel 150 to the foundation 102. In this fashion, a strong structure for house 100 is provided.

Referring now to FIG. 13, the panel mount 170 with panel bolts 172 and anchoring shelf 174 are secured in the forming assemblies 300. The anchoring shelf 174 and panel bolts 172 into the panel 150 and is more clearly shown. The extended bolt 176. This plate or anchoring shelf 174 supports the panel bolts 172 and provides for the attachment of one panel 150 to the other by means of extended bolt 176, and the flat roof 120 or the gabled roof 128 to the panels 150.

In FIGS. 14 and 15, the wire reinforcement 350 is depicted within the forming assemblies 300. This wire reinforcement 350 is a cage like device having vertical rods 352, horizontal rods 354, and arcuate rods 356 welded or otherwise secured together at intersecting points 358. The thus-formed cage of wire reinforcement 350 is mounted in the forming assemblies 300 between first mold form 304 and second mold form 306. The concrete 302 is poured into forming assemblies 300 and owed to harden in order to form panel 150.

This hardening is done with forming assemblies 300 mounted in a vertical position. Then first mold form 304 is separated from second mold form 306. The recovered panel 150 may be stored or used.

Mounted on the wire reinforcement 350 are slotted circular members 370. Circular member 370 includes a hub 372, connected to an outer rim 374 by a slot 376. With slot 376, outer rim 374 may be placed over vertical rods 352, horizontal rods 354, arcuate rods 356, or combinations thereof into hub 372.

Intermediate rims 378 and spokes 380 reinforce the circular member 370. Spokes 380 connect the hub 372 to the outer rim 374. Spokes 380 also connect adjacent intermediate rims 378. The effect of these circular members 370, being used as spacer mechanisms, sometimes also called chairs, space the wire reinforcement 350 from the forming assemblies 300. In this fashion, the wire reinforcement 350 does not appear through the concrete 302 that is poured in the forming assemblies 300.

In FIG. 15, it can be seen that insulation 152 can be placed in the forming assemblies 300 and within wire reinforcement 350. With this insulation 152 in the forming assemblies 300, the molded panel 150 receives a high R rating suitable for insulation 152. This insulation 152 greatly simplifies the heating process of the house 100 and provides for an efficient method of heating or cooling house 100.

FIG. 16 depicts a end view of the capped mold spacer 400. Capped mold spacer 400 additionally supports the wire reinforcement 350 within the forming assemblies 300. Capped mold spacer 400 has a flexible protective cap 402 mounted on an end of vertical rods 352 or horizontal rods 354.

Figure 17:
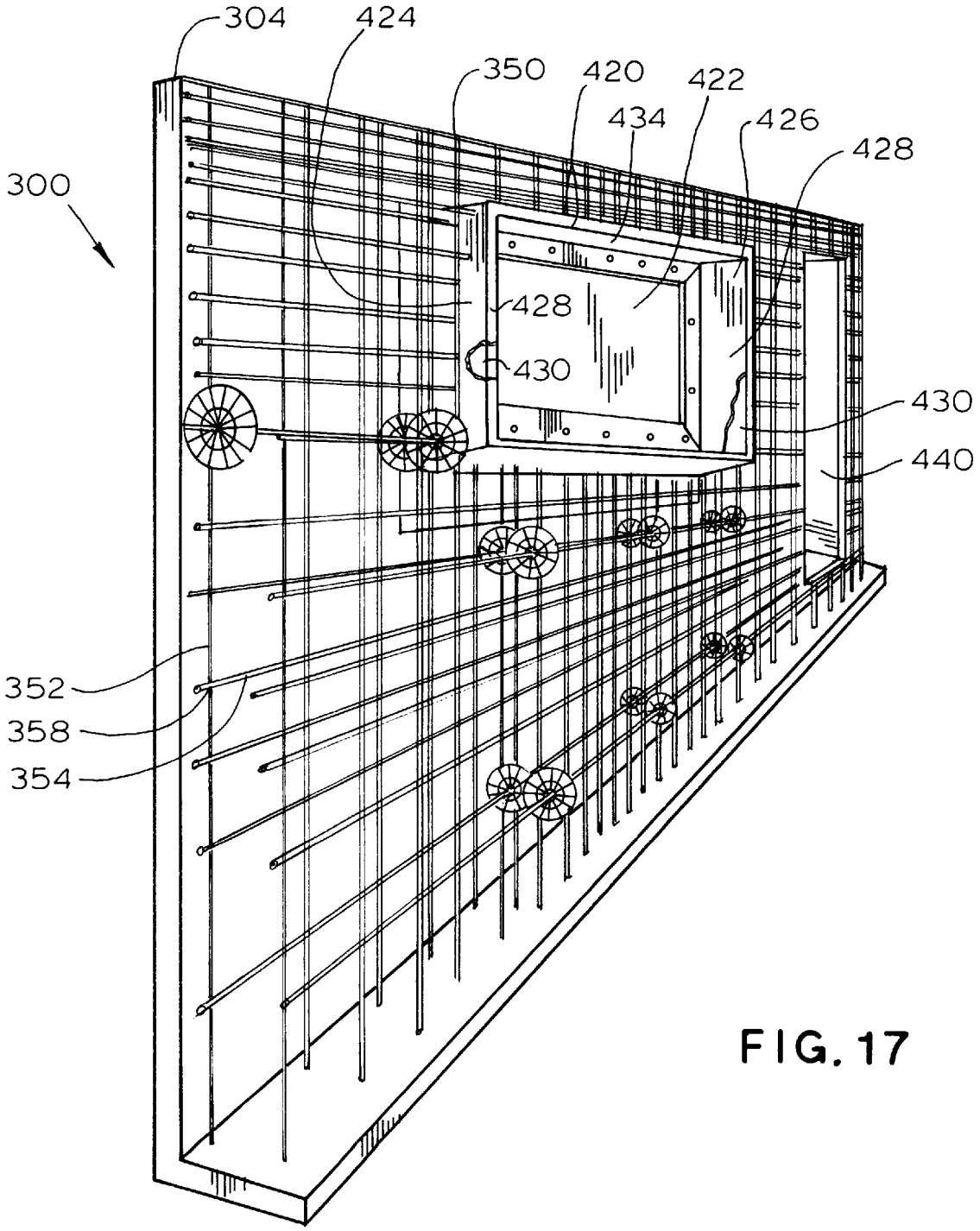
FIG. 17 depicts an interior perspective view of a first form 304 of forming assembly 300, for panel 150, in partial cross-section.

In FIG. 17 the wire reinforcement 350 is shown as assembled on one side of the forming assemblies 300. Also within that package is a window spacer 420 to form a window space 422 in the panel 150. The first side window member 424 and the second side window member 42G are flexible to assist removal of panel 150 from forming assemblies 300.

A preferred flexible member for forming the window space 422 is urethane 428 encased around plywood 430. These members are sturdy enough to support the formation of the window space 422 in the panel 350, when secured to first mold form 304 in a standard fashion, yet flexible enough to move to permit the first form 304 and second form 306 of the forming assemblies 300 to be moved from the formed panel 150. In this fashion, a door space 440 may also be formed.

The upper frame 434 for window space 422 is rigid member, welded or otherwise secured to mold form 304. Likewise, lower frame 436 for window space 422 is attached in a similar fashion. Door space 440 is formed by similar construction.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A mold assembly for shaping a panel for use in constructing a building comprising:

(a) the mold assembly including a first vertical mold wall and a second vertical mold wall;

(b) the first vertical mold wall and the second vertical mold wall including a means for moving the first mold wall adjacent to the second mold wall, the panel being castable between the first vertical mold wall and the second vertical mold wall in the mold assembly;

(c) a wire reinforcement assembly being situated within the mold assembly;

(d) means for mounting the wire reinforcement assembly within the mold assembly;

(e) at least one flexible molding means adapted to form an opening being mounted within the mold assembly; and (f) a spacing means for spacing the wire reinforcement assembly from the first mold wall and the second mold wall.

2. The mold assembly of claim 1 further comprising:

(a) the at least one flexible molding means being adapted to form at least one opening selected from the group consisting of at least one door and at least one window;

(b) the at least one flexible molding means having an upper ledge and a lower ledge mounted on the first vertical mold wall;

(c) the at least one flexible molding means having a first side edge and a second side edge mounted on the first vertical mold wall;

(d) the upper ledge, the lower ledge, the first side edge and the second side edge combining to form the at least one opening suitable; and (e) the first side edge and the second side edge being flexible in order to assist removal of the panel from the mold.

3. The mold assembly of claim 2 further comprising:

(a) the spacing means being at least one slotted, spoked wheel; and (b) the at least one slotted, spoked wheel being slidably mounted on a wire strand, the wire strand being a part of the wire reinforcement assembly.

4. The mold assembly of claim 3 further comprising:

(a) the spacing means further including at least one cap; and (b) the at least one cap being positioned on at least one end of the wire strand in the wire reinforcing means.

5. A method of molding a panel suitable for use to form a building comprising:

(a) forming a vertical mold assembly having a first mold surface and a second mold surface;

(b) mounting a wire reinforcement cage between the first mold surface and the second mold surface to reinforce the panel;

(c) providing a spacing means for the wire reinforcement cage in order to separate the wire reinforcement cage from the first mold surface and the second mold surface;

(d) providing at least one flexible molding means adapted to form an opening within the vertical mold assembly;

(e) moving the first mold surface sufficiently close to the second mold surface to permit insertion of a flowable material into the mold assembly for the purpose of shaping the panel from the flowable material;

(f) adding the flowable material into the mold assembly;

(g) allowing the flowable material to harden in order to form the panel; and (h) recovering the panel from the mold assembly.

6. The method of claim 5 further comprising:

(a) applying an exterior surface to the first mold surface before adding the flowable material; and (b) applying an interior surface to the second mold surface before adding the flowable material.

7. The method of claim 6 further comprising:

(a) forming a desired, duplicatable surface with a container;

(b) applying a casting resin to the duplicatable surface;

(c) allowing the casting resin to solidify into the exterior surface; and (d) applying the exterior surface to the first mold surface.

8. The method of claim 7 further comprising:

(a) providing an opening forming device on the first mold surface in order to create an opening in the panel, the opening being at least one opening selected from the group consisting of a door opening and a window opening;

(b) providing at least one flexible side for the opening forming device to permit easy release of the panel from the mold assembly;

(c) providing mounting bolt assemblies in the mold assembly at precise points in the mold assembly prior to adding the flowable material, in order to provide for the panel to be assembled as part of the building using the bolt assemblies; and (d) providing at a rigid top support for the opening forming device to permit easy release of the panel.

9. The method of claim 5 further comprising:

(a) applying an exterior surface to the first mold wall before adding the flowable material;

(b) applying an interior surface to the second mold wall before adding the flowable material;

(c) forming a desired, duplicatable surface with a container;

(d) applying a casting resin to the duplicatable surface;

(c) allowing the casting resin to solidify into the exterior surface;

(d) applying the exterior surface to the first mold wall;

(e) providing an opening forming device on the first mold surface, in order to create an opening in the panel, the opening being at least one opening selected from the group consisting of a door opening and a window opening;

(f) providing at least one flexible side for the opening forming device to permit easy release of the panel;

(g) providing a plurality mounting bolt assemblies in the mold assembly at precise points in order to provide for the panel to be assembled as part of the building using the bolt assemblies; and (h) providing a rigid top support for the opening forming device in order to permit easy release of the panel.

10. A mold assembly for shaping a panel for use in constructing a building comprising:

(a) the mold assembly including a first vertical mold wall and a second vertical mold wall;

(b) the first vertical mold wall and the second vertical mold wall including a means for moving the first mold wall adjacent to the second mold wall, the panel being castable between the first vertical mold wall and the second vertical mold wall in the mold assembly;

(c) a wire reinforcement assembly being situated within the mold assembly;

(d) means for mounting the wire reinforcement assembly within the mold assembly;

(e) a spacing means for spacing the wire reinforcement assembly from the first mold wall and the second mold wall;

(f) a flexible window molding means being mounted within the mold assembly;

(g) the flexible window molding means having an upper ledge and a lower ledge mounted on the first vertical mold wall;

(h) the flexible window molding means having a first side edge and a second side edge mounted on the first vertical mold wall;

(i) the upper ledge, the lower ledge, the first side edge and the second side edge combining to form an opening suitable for a window or a door in the panel; and (j) the first side edge and the second side edge being flexible in order to assist removal of the formed panel from the mold.

11. The mold assembly of claim 10 further comprising:

(a) the spacing means being at least one slotted, spoked wheel;

(b) the at least one slotted, spoked wheel being slidably mounted on a wire strand, the wire strand being a part of the wire reinforcement assembly;

(c) the spacing means further including at least one cap; and (d) the at least one cap being positioned on at least one end of at least one member of the piece of wire in the wire reinforcing means.

* * * * *